US010555872B1

(12) United States Patent
Thorne

(10) Patent No.: US 10,555,872 B1
(45) Date of Patent: Feb. 11, 2020

(54) CONVENIENCE KITS FOR ASEPTIC STERILIZING AND DISPENSING

(71) Applicant: Gale Harrison Thorne, Bountiful, UT (US)

(72) Inventor: Gale Harrison Thorne, Bountiful, UT (US)

(73) Assignee: THORNE INTELLECTUAL PROPERTY HOLDINGS, LLC, Bountiful, UT (US)

( * ) Notice: Subject to any disclaimer, the term of this patent is extended or adjusted under 35 U.S.C. 154(b) by 8 days.

(21) Appl. No.: 16/350,279

(22) Filed: Oct. 25, 2018

(51) Int. Cl.

| | |
|---|---|
| ***A61J 1/00*** | (2006.01) |
| ***A61J 1/20*** | (2006.01) |
| ***B65B 5/06*** | (2006.01) |
| ***B65B 3/00*** | (2006.01) |
| ***B65B 55/02*** | (2006.01) |

(52) U.S. Cl.
CPC ..... *A61J 1/2096* (2013.01); *A61J 1/2086* (2015.05); *B65B 3/003* (2013.01); *B65B 5/068* (2013.01); *B65B 55/02* (2013.01)

(58) Field of Classification Search
CPC ..... A61J 1/2096; A61J 1/2079; A61F 17/00; A61B 50/30; A61B 50/33; A61B 2050/314; B65B 3/003
USPC ..... 206/570, 363, 370, 366, 364, 438
See application file for complete search history.

(56) References Cited

U.S. PATENT DOCUMENTS

| | | | | |
|---|---|---|---|---|
| 3,690,315 | A * | 9/1972 | Chittenden | A61F 5/441 206/363 |
| 4,146,153 | A | 3/1979 | Bailea | |
| 5,707,173 | A * | 1/1998 | Cottone | A61M 5/3205 206/366 |
| 6,164,044 | A * | 12/2000 | Porfano | B65B 55/10 422/28 |
| 8,056,719 | B2 * | 11/2011 | Porret | A61L 2/26 206/370 |
| 8,286,791 | B2 * | 10/2012 | Finke | A61M 5/008 206/366 |
| 8,449,521 | B2 | 5/2013 | Thorne, Jr. et al. | |
| 9,149,939 | B2 * | 10/2015 | Zambaux | B25J 21/02 |
| 9,636,444 | B2 * | 5/2017 | Burbank | A61M 1/1656 |
| 9,937,288 | B2 * | 4/2018 | Wright | A61M 5/002 |

* cited by examiner

*Primary Examiner* — Steven A. Reynolds
(74) *Attorney, Agent, or Firm* — Gale H. Thorne

(57) ABSTRACT

A convenience kit for sterilizing and delivering liquids into the safety of a sterile environment inside a plastic bag (which can be disposed in a field environment) wherein a so sterilized liquid is dispensed into a vessel which is capped and sealed before removal from the bag. The convenience kit can be provided in a solitary format or, as a subkit combined with other associated items in a more inclusive convenience kit. In short, convenience kits made according to the present invention provide opportunity for accomplishing an aseptic liquid sterilizing transfer, a task which is commonly associated with on-hand capability of a laminar flow hood, in field environments and other areas which are remote from facilities having laminar flow hoods.

4 Claims, 6 Drawing Sheets

CONVENIENCE KITS FOR ASEPTIC STERILIZING AND DISPENSING

FIELD OF INVENTION

This invention relates generally to devices for medical procedures involving liquid transfer, sterilization and mixing in a field environment. It is also particularly related to kits and to methods which employ preassembled parts to provide a sterile product without requiring confines of a laminar flow hood.

BACKGROUND AND DESCRIPTION OF RELATED ART

Conventionally, mixing and formulation of medications is a pharmacy or other medical laboratory performed function most often involving use of laminar flow hoods and strict aseptic technique to maintain sterility. In pharmacies, medical solutions are often passed through a medical grade sterilizing filter to assure an aseptic condition. Resulting products from these facilities are highly regarded and widely used in hospitals and other clinical facilities.

However, today, a significant portion of medical practice takes place outside sophisticated medical institutions. As an example, a new and very effective eye-wash technology is based upon mixing autologous blood serum with normal saline in exacting proportions. Commonly, blood is drawn from patients in a wide range of areas remote from pharmacies and laboratories. The expense and inconvenience of relying on such facilities to sterilize and mix is prohibitive, negatively affecting broader application of this promising technology. Thus, there exists a severe contemporary need for a process or methodology, not currently available commercially, which can, with appropriate safety and efficacy, provide such sterilizing, dispensing and mixing in a field environment.

Convenience kits have become commonly used appliances for a number of reasons. First, a convenience kit is specifically made for a given application. Contents of each such kits are prepared and provided in a form which generally reduces procedure steps and improves efficiency. Second, such kits can provide additional safety such as the kit disclosed in U.S. Pat. No. 9,449,521, titled METHODS FOR MAKING AND USING A VIAL SHIELDING CONVENIENCE KIT, issued May 28, 2013, which proved effective in providing additional safety to technicians and patients by keeping hazardous drug fumes and liquid fully contained.

Terms and Definitions

Following is a list of terms and associated definitions which are provided for clarity and understanding when used to disclose precepts of the instant invention:

dead space, n: a volume of inaccessible fluid which is retained within a device after a procedure digital, adj: relating to, or done with thumb or fingers ETO, n: acronym for ethylen oxide, a powerful sterilizing agent field of use, n: a location in an uncontrolled environment in which potentially health-hazardous materials are present.

filter, n: a product material having a sufficiently small porous matrix to impede passage there through of a particulate of predetermined size; a medical grade sterilizing filter generally has a 0.2 micron pore size.

filter component, n: A housing for a filter having a a pair of opposing fittings providing communicating conduits to and from the filter.

fitting, n: a medical connector kit, n: a group of parts, provided within a single package for a designated use laminar flow hood, n: (a fume hood) a work-place enclosure in which air flow is directed so as to prevent contamination of sterile materials by airborne organisms luer fitting, n: a medical connector having a frustoconically shaped connecting geometry which is in common use in medical practice luer lock fitting, n: a luer fitting having a locking mechanism whereby a male and female connector are securely, but releasibly affixed one to the other plastic bag, n: a sturdy container made of clear pliant material which comprises an opening initially available at one end for product insertion which is sealed thereafter to provide a totally enclosed product shroud, the material being sufficiently pliant to permit digital product handling from outside the container interface gasket, n: an elongated hollow tube that is sized, shaped and disposed to be affixed along a filter component conduit about a hole in a plastic bag and thereby provide a fluid tight seal gasket support, n; a rigid washer shaped component which has an outer diameter which is similar to an outer diameter of a gasket and an inner diameter which interfaces with a luer connecting fitting and thereby transfers force from the connecting fitting to an interface gasket to provide a seal port or portal, n: an orifice site where through fluid is communicated (generally associated with a sealed conduit disposed there through)

radiation, n: generally gamma radiation imposed with sufficient intensity and time to sterilize a product to a desired SAL (sterility assurance level)

subkit, n: a group of parts provided as a unit and considered to be a kit when provided alone but a lesser kit form when provided as a part of a more inclusive kit which is packaged with additional items tray, n: a convenience kit container wherein kit parts are stored and transported tray cover, n: a removable cover which is disposed and sealed over a tray to provide a clean shroud unitized, adj: a plurality of separate parts permanently joined to be handled and used as a single unit insulated wrap, n: a flexible container which may be a bag or folded shield which is sealed to provide a container in which enclosed parts can be maintained at a reduced temperature

BRIEF SUMMARY AND OBJECTS OF THE INVENTION

In brief summary, this novel invention alleviates all of the known problems related to mixing, dispensing and providing a sterile liquid product in a field environment.

Commonly, such products, as disclosed supra, are often produced by being sterilized by filtration and mixed under a fume or laminar flow hood in a pharmacy or laboratory facilities. For products which are acquired for sterilizing and mixing in a field environment, remote from such facilities, lack of a fume hood or laminar flow capability currently prohibits wide-spread manufacturing It is for the purpose of fulfilling this need that a convenience kit based upon the instant invention is intended.

The core items of this inventive kit are a conventional commercial plastic bag, having an accessible opening, which is closed and sealed after product assembly, and a sterilizing filter component which is affixed to the bag via a sealed portal to provide a solitary sterilizing fluid pathway to other components inside the so closed bag. To assure product sterility, the bag and contained articles are sterilized after assembly prior to use. Once sterilized, the only passageway inside the sealed bag is through the filter component. Therefore, all product inside the bag remains sterile for all subsequent procedures until the bag is opened.

The inventive kit may be delivered as a constituent of a larger, more inclusive kit comprising additional items for a particular procedure. In such a case, the inventive kit is part of the larger kit and is referenced as a subkit. As is clearly disclosed hereafter, other products delivered in the inclusive kit should be clean, but need not be sterilized before use with the inventive kit.

An example of components of a kit made according to the present invention may be as follows:

1. The plastic bag having an accessible opening for displacement of the articles into the bag before the opening is closed and sealed and an exterior surface which completely envelopes and protects sterility of articles disposed therein. Bag and articles disposed therein should be predisposed to digital manipulation via the bag exterior.

2. A filter component comprising a sterilizing grade filter and two opposing elongated conduits having connecting fittings at ends remote from the filter. One of the conduits, is displaced through a hole in the bag. A gasket seal is disposed about the conduit/hole interface, providing a hollow conduit as the only fluid access pathway into the bag after the bag opening is sealed. Note that the pathway leads to the filter through which all fluid must pass, thereby assuring that no non-sterile material can be introduced into the bag beyond the filter.

3. At least one vessel for receipt of dispensed liquids.

4. A cap for each at least one vessel, the cap being affixable and providing a protective seal, such that when attached to the vessel and thereafter removed from the bag, following liquid transfer, product sterility is assured.

5. A receptacle for holding each at least one vessel and associated cap in a preferred accessible position and state. (Optional)

6. A basin wherein wasted priming (waste) liquid can be delivered. (Optional)

One of the compelling purposes for basic convenience kits resulting from this invention is providing fluid flow through an associated sterilizing filter. As liquids to be mixed in a field environment can be expected to be compromised and/or contaminated, it is critical that every so-employed liquid is passed through such a filter and sterilized before being dispensed within the bag. In the case of the instant invention, retention of sterility throughout dispensing and mixing is equally as important. For this reason, all kit mixing, sterilization and subsequent packaging functions are performed within a plastic bag which retains such sterility until reopened. It is important to note that digital facility of kit use is also very important. As a consequence, final product is not removed from the bag until capped and sealed for safe transport in the field environment. Note that this requires product dispensing and capping take place within the bag.

As well as providing for field sterilization and mixing, a convenience kit according to the present invention, may be a sub-kit supplied in a more inclusive kit format, comprising parts supplied unpackaged within the confines of a kit container, for saving time and steps. Additional time may be saved by unitizing assembly of functional parts of the kit. For example, those sub-kit components which are not separated as part of the procedure are securely affixed as a unit (unitized), one to another (such as by adhesion). As an example, a fluid delivery spout can be securely affixed to an output conduit of a filter component internal to the bag and a fluid delivery control unit may be affixed to an input conduit of the filter. In this manner, sub-kit components are provided to a handler in a "ready to use" format which is inherently incorruptible.

Inclusive kits, based upon the present invention, may have a variety of components disposed within a transport tray. While such components and items can be selected and fixed for each particular application, a wide diversity of parts may be used for both components and items within the scope of the invention. However, in all cases, components are generally affixed one to another, as necessary, to provide a "ready to use" configuration. Also, if gamma radiation is used for sterilization, only radiation stable components should reside within the bag of the inventive kit.

As disclosed hereafter, various convenience kit configurations may be used for sterilizing, transferring and mixing, as the filter component permits a wide range of sterilizing applications that fit within a bag. Other application examples for the instant invention includes batch filling of antibiotic and operating room syringe kit applications, oncology drug dispensing, short half-life drug delivery and kits for home care.

Further, to show by example, a comparison of advantages and disadvantages relative to using a convenience kit made according to the present invention versus using a laminar flow hood, for a sterile transfer process, distinctions are summarized in the following two tables (i.e Tables 1 & 2).

Table 1 summarizes a comparison of general factors related to preparing an eye-wash product using a laminar flow hood and the convenience kit.

TABLE 1

| Parameters | Laminar Flow Hood | Present Invention |
|---|---|---|
| Number of packages to open | 15 | 1 |
| Filter | .2 micron-small tip | .2 micron-high flow |
| Maintenance of sterility | Technique dependent | All items in bag and entering bag are pre-sterilized-virtually impossible to contaminate accidentally |
| Likelihood of product contamination | Low | Remote |
| Receiving vessel stability | Usually no special stabilizers used | A stabilizing receptacle can be provided within the bag |
| Injection into receiving vessels | Filtered liquid through a filtered air stream | Sterilized by filter before dispensing into a sterile field |
| User steps | 42 | 24 |
| Ease of use | Simple with proper training | Simpler with conventional technique |

Table 2 compares a current process of producing an eyewash product to a like product production using a convenience kit made according to the present invention.

TABLE 2

| Parameters | Conventional | Present Invention |
|---|---|---|
| Open Packages | 15 | 1 |
| Set up receiving vessels | 4 | 0 |
| Draw serum into syringe from vacutainers | 9 | 9 |
| Purge air from syringe | 1 | 1 |
| Draw saline into delivery syringe | 3 | 3 |
| Mix | 1 | 1 |
| Attach filter to syringe | 1 | 1 |
| Dispense into four receiving vessels | 4 | 4 |
| Cap vessels | 4 | 4 |
| Total | 42 | 24 |

Accordingly, it is a primary object to provide convenience kit methods and apparatus for transferring and sterilizing liquids to provide a packaged, sealed, aseptic product in a field environment.

It is a principle object to provide methods and apparatus which can be used for preparing and using convenience kits for sterilizing and delivery of filled sterile liquid containing vessels into a field environment.

It is an object to provide a convenience kit and methods and apparatus for preparing a mixed eye-wash solution in a field environment.

It is an object to provide methods and apparatus which can be used for preparing and using convenience kits for sterilizing and delivery of batch filled antibiotics.

It is an object to provide methods and apparatus for preparing and using convenience kits which can be used for sterilizing and delivery of drugs in home care situations.

It is an object that a sectioned tray, having at least two recesses wherein the instant invention is stored and transported as a sub-kit and other objects are separately stored, be provided.

It is a fundamental object that the bag be sealable, be able to be opened for use of products transferred, sterilized and mixed.

It is a crucial object that connected parts disposed in the inner bag be adjoined to reduce makes and breaks after sterilization.

It is another critical object that such adjoined parts be unreleasibly affixed (unitized) to preclude separation in transport and storage.

It is a another major object that bagged parts of a convenience kit made according to the present invention be digitally accessible such that liquid sterility protecting caps can be affixed to vessels before perforating the bag barrier.

These and other objects and features of the present invention will be apparent from the detailed description taken with reference to accompanying drawings.

DETAILED DESCRIPTION OF THE ILLUSTRATED EMBODIMENTS

In this description, the term proximal is used to indicate a segment of a device normally closest to an object of the sentence describing its position. The term distal refers a segment oppositely disposed. Reference is now made to the embodiments illustrated in FIGS. 1-13 wherein like numerals are used to designate like parts throughout. For parts which are similar but not the same as parts originally specified with a given number, a prime of the original numbers is used.

While kits made according to the invention may be configured to provide assemblies for many medical procedures, such as those, for example, involved with sterile washes and drugs for home-care, antibiotics, operating room and pediatrics, disclosure of an exemplary application in the area of preparation of a specialized eye-wash is herein selected to provide examples and details of the instant invention while clearly demonstrating critically important safety and time and work saving features.

Figure 1:
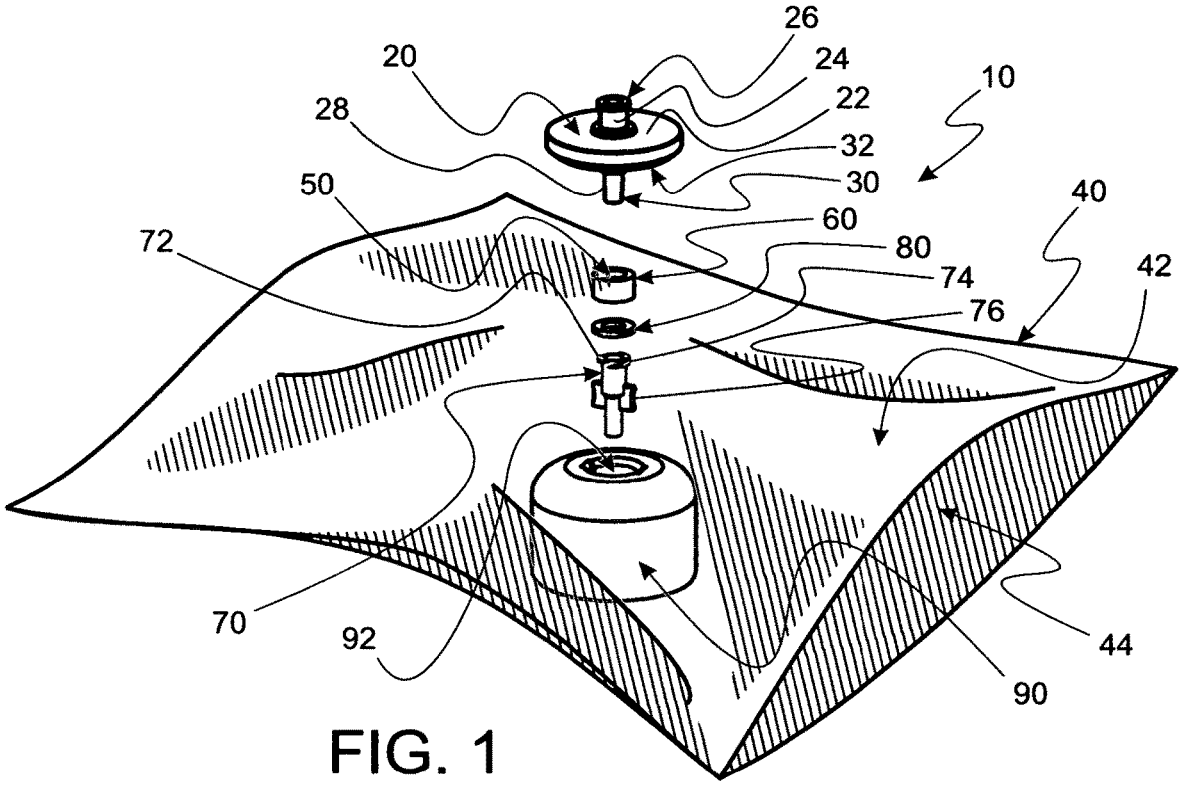
FIG. 1 is a perspective of a plastic bag having an open end with a filter component disposed outside the bag and associated assembly and sealing and components and an assembly tool disposed within confines of the bag.

Reference is now made to FIG. 1 wherein significant components of a convenience kit 10 made according to the instant invention are seen. The components are:

a. a sterilizing filter component 20 comprising a filter casing 22, two elongated fluid communicating conduits with luer fittings on an end disposed away from filter component 20, (i.e. a first conduit 24 comprising a female luer fitting 26 and a second conduit 28 with a male luer fitting 30). A filter (not shown) is disposed within filter component 20, through which all fluid displaced through the conduits 24 and 28 must pass. The filter is a medical grade sterilizing filter which is defined to be on the order of a 0.2 micron filter rating. Filter component 20 should have a substantially planar face 32 for interfacing with a portion of the exterior surface of an associated plastic bag. Such a filter is currently available commercially as a Merck Millipore MILLEXGS Sterilizing Filter unit.

b. a pliant, preferably clear plastic bag 40 comprising a continuous surface 42 and a single opening 44 which is heat sealable. Such a bag is found commercially in many forms. As an example, a 1.4 mil poly leak-proof, heat sealable bag is currently preferred. The selected bag should be sized to permit digital access to contents within the bag. Such bags can be perforated by a sharp object such as a common pin at a desired perforation site (in this example, site 50). Note that site 50 can be determined to be any desired place on the surface of bag 40 which permits desired digital maneuvering of filter component 20. At such a perforation, material characteristics of the bag permit displacement of a conduit part through the point of perforation with only an increase in hole size equivalent to circumference of the perforating member (i.e. in this case, filter conduit 28).

c. three components which can be used to seal the perforated hole at site 50.

Figure 1A:
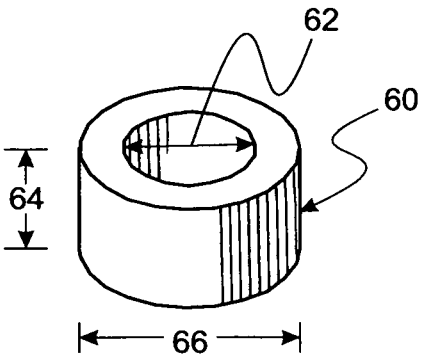
FIG. 1A is a perspective of a section of tubing to be used as a sealing interface gasket having predetermined length and internal diameter relative to the filter component seen in FIG. 1.

The first component 60 is preferably a section of tube stock which is elastic, pliant, and incompressible having an internal diameter which tightly fits about conduit 28 adjacent filter casing 22 and preferably has an external diameter 66 (see FIG. 1A) which provides a ⅛ inch cushion about conduit 28 and a length 64. An example of such tube stock is silicone tubing.

The second component 70 performs as a nozzle extension for conduit 28 and preferably comprises a female luer fitting 72 comprising side flanges 74 which are designed to be luer-lock latches. Fitting 70 can be a conventional male/female luer-lock fitting. Component 70 also preferably has a pair of rigid side wings 76.

The third component 80 is a washer shaped component which is sized to communicate with fitting 72 flanges 74 and a proximal surface of component 60. Component 80 should be sufficiently rigid to retain a planar form when disposed to communicate connective forces between fitting 72 and tubing component 60 to thereby provide gasket support.

Note that component 60 (being and interface gasket) when used as a gasket part is disposed about conduit 28 between flanges 74 and face 32. Component 60 should be a section of tubing having a length, as cut, which is sufficiently greater than the distance between flanges 74, and face 32 of filter component 20 to provide force forming a fluid tight seal against bag 40 interior surface in contact with planar face 32, but short enough to not generate a force sufficient to disengage component 70 from conduit 28.

A filter to bag fabrication tool 90 is seen to provide a walled hole 92 which has a pair of slots (not shown) disposed to fit about side wings 76 to retard component 70 from rotating as component 70 is securely affixed to conduit 28 (by conventional luer fitting attachment technique). Assembly process is as follows:

Components 60, 80 and 70 and tool 90 are disposed within bag 40. Component 70 is displaced into hole 92 such that wings 76 are retarded from rotating. Bag surface 42 is pierced at site 50 providing a pin sized hole. Conduit 28 is forcefully displaced through bag surface 42 at site 50. Component 60 is displaced about conduit 28. Component 80 is next displaced about conduit 28 in contact with component 60. Then, making a luer connection, component 70 is securely affixed to conduit 28. It is preferable that an adhesive is disposed to interface between connecting surfaces of conduit 28 and component 70 to assure long term product stability. Tool 90 is displaced from bag 40.

Figure 2:
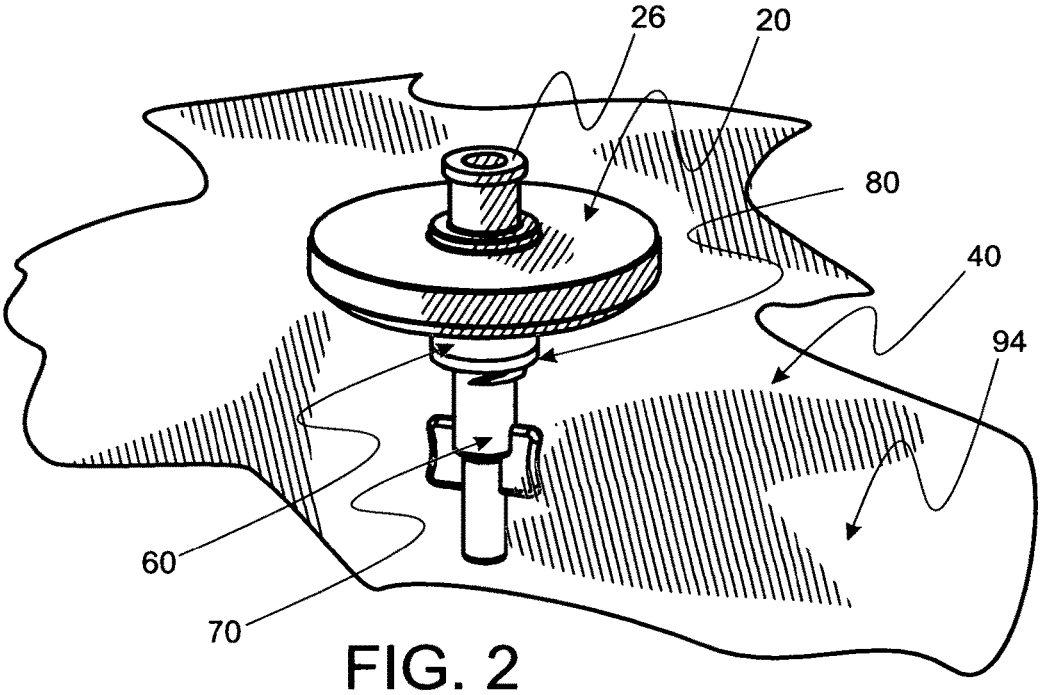
FIG. 2 is a perspective of a segment of the bag seen in FIG. 1 with a portion of the filter component disposed outside the bag and another portion disposed through an orifice disposed in the bag (but unseen) and interconnected orifice sealing components disposed within the bag.

In FIG. 2, an assembled combination is seen showing filter component 20 affixed through a closed and sealed hole to bag 40 (showing female luer fitting 26 disposed outside bag 40) and components 60,80 and 70 linearly disposed within bag 40. Only a segment 94 of bag 40 is seen for clarity of presentation.

Figure 3:
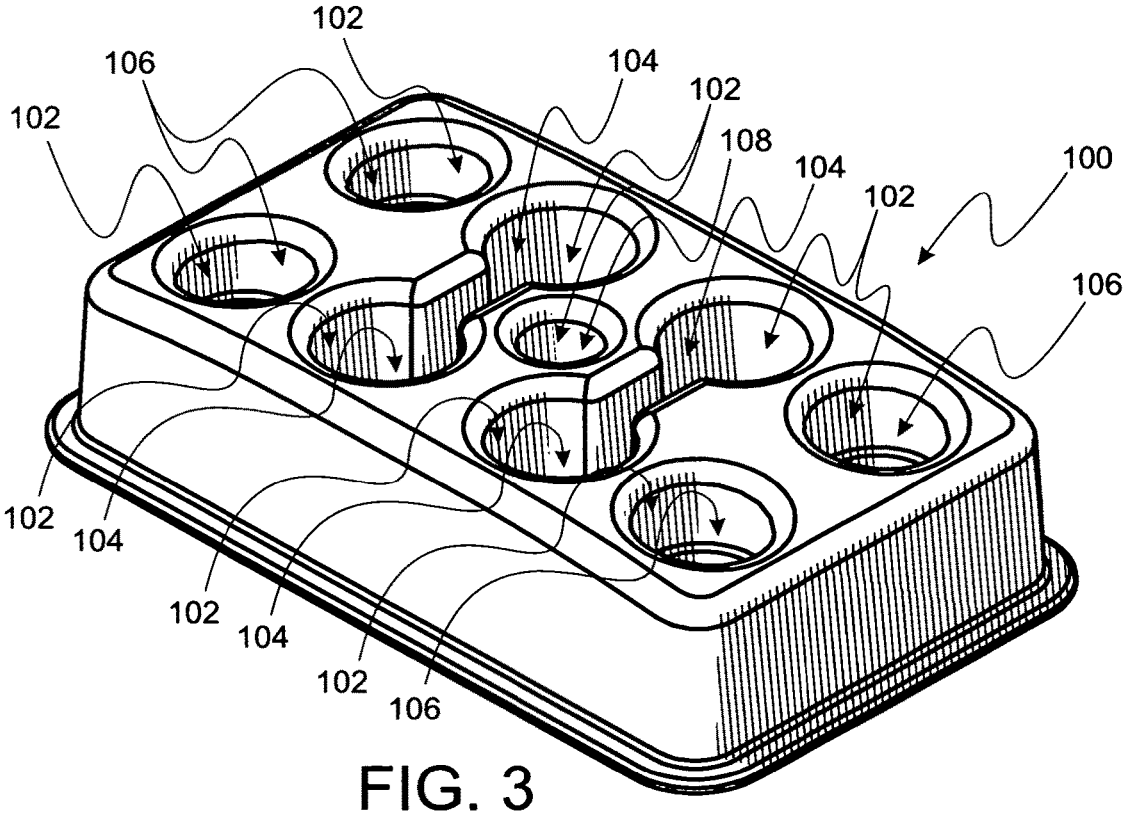
FIG. 3 is a perspective of a receptacle designed for use in an exemplary application of the present invention, the receptacle providing for stabilizing receiving vessels and caps within the bag.
Figure 5:
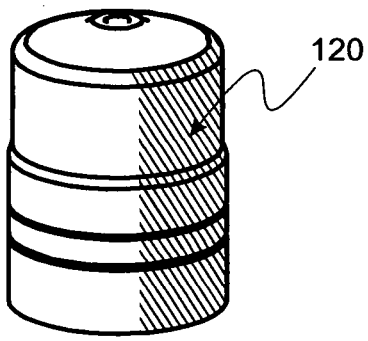
FIG. 5 is a perspective of a cap for closing and providing a seal to protect contents of the vessel seen in FIG. 4.
Figure 4:
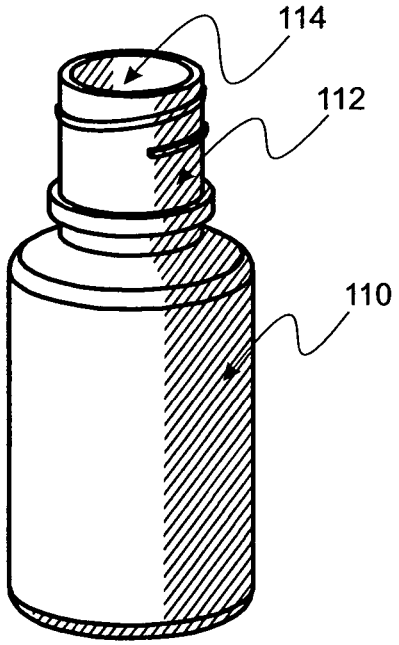
FIG. 4 is a perspective of a vessel to be disposed within the receptacle seen in FIG. 3.

Attention is now referenced to FIGS. 3, 4 and 5 wherein components of a set for producing a sterile eye-wash product are seen. In FIG. 3, a stabilizing tray 100 is seen to comprise a series of cavities, generally numbered 102, each of which has a specific purpose as disclosed hereafter. Tray 100 may be made of polystyrene or other rigid plastic which is radiation stable. Vacuum or other molding methods may be employed to fabricate tray 100. In this example, cavities 102 which are dedicated to eye-wash receiving vessels are also numbered 104. Cavities 102 which are dedicated to caps for the vessels are numbered 106. A single cavity 108 is centrally disposed and has multiple functions, one of which is acting as a reservoir for receipt of priming residue.

A vessel 110 for receiving and storing eyewash is seen in FIG. 4. As vessel 110 is used for dispensing eye drops it should be fabricated of flexible material which is radiation stable. Vessel 110 comprises a threaded, superiorly disposed wall 112 about an opening 114.

A sealing and protective cap 120 for vessel 110 is seen in FIG. 5.

Figure 6:
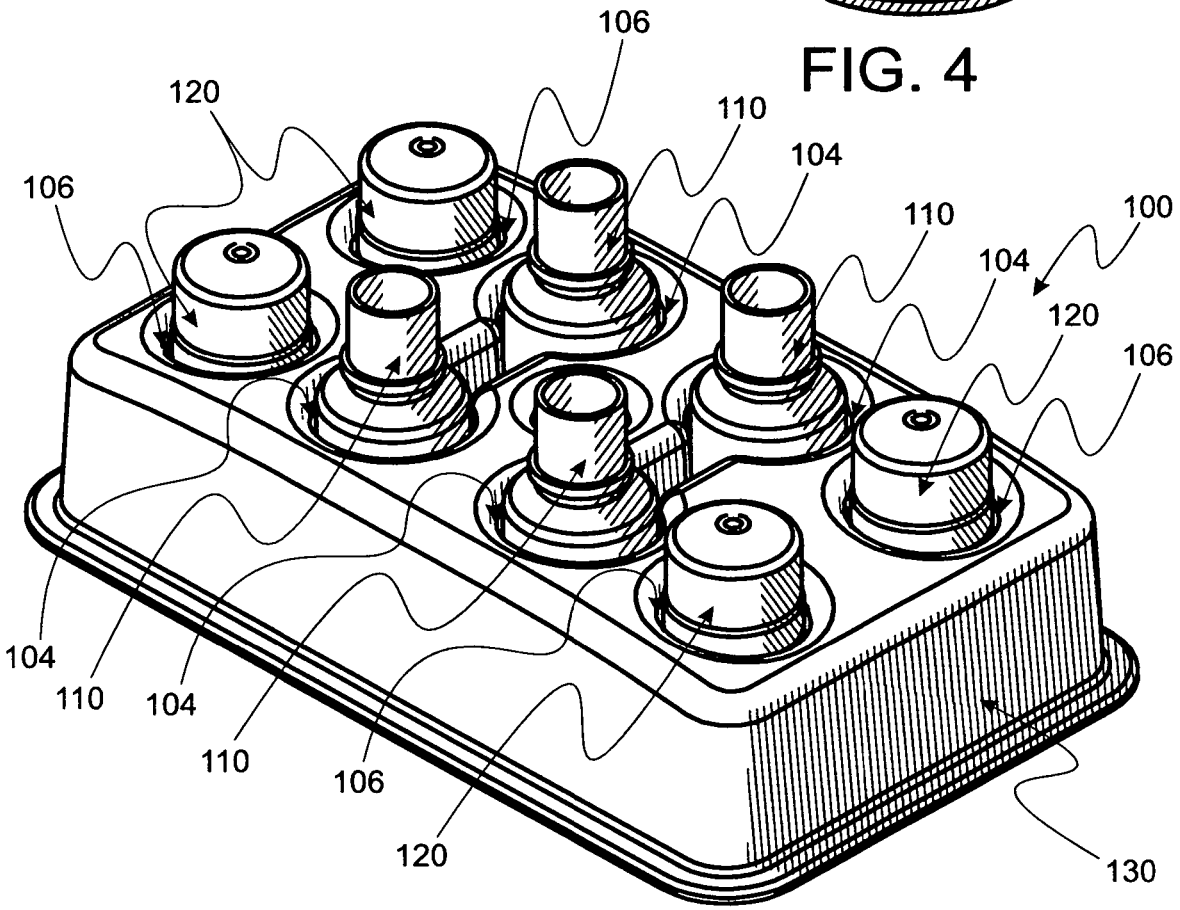
FIG. 6 is a perspective of the receptacle seen in FIG. 3 filled with vessels seen in FIG. 4 and caps seen in FIG. 5.

Cavities 106 are sized and shaped to securely, but releaseably, retain caps 120 therein, as seen in FIG. 6. Cavities 104 are sized and shaped to securely, but release-ably, retain vessels 110. The combination of a tray 100 laden with caps 106 and vessels 104 is referenced as filled tray 130 hereafter.

Figure 7:
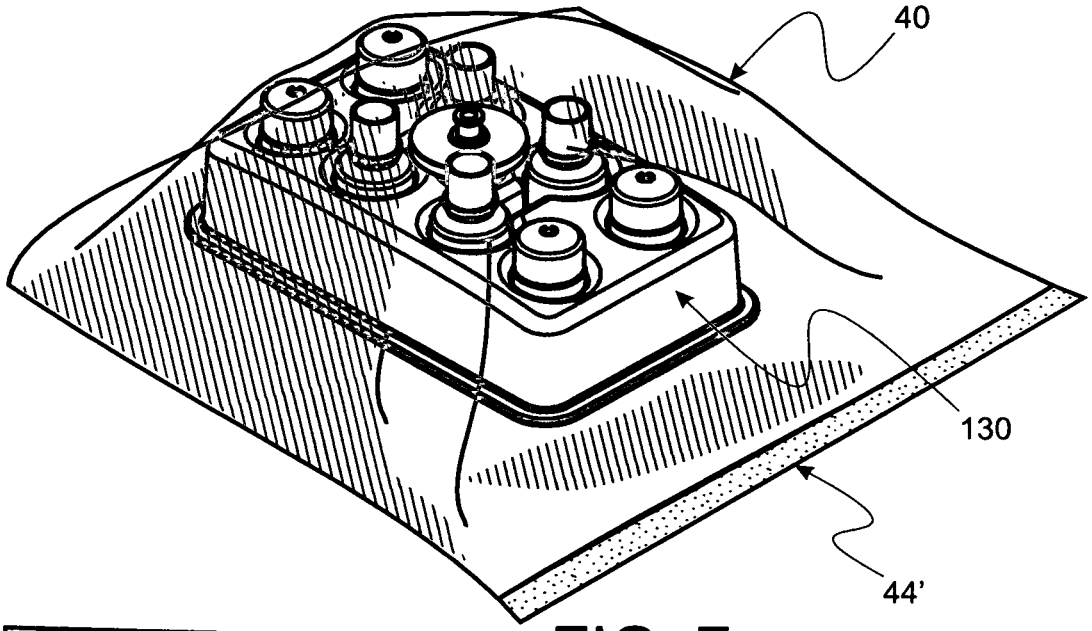
FIG. 7 is a perspective of a bag comprising an affixed filter as seen in part in FIG. 2 and a filled receptacle disposed within a bag and the open end closed and sealed.

A first step in convenience kit assembly is displacing a filled tray 130 (see FIG. 6) into bag 40 through opening 44 (see FIG. 1) as seen in FIG. 7. After the tray is so disposed, bag opening 40, as a second step, is closed and sealed (forming closed opening 44') as also seen in FIG. 7. Note that conduit 28 can be disposed in cavity 108 for packaging and storing purposes.

A third and final assembly step for providing a ready to use convenience kit 200 (seen in FIG. 8) is sterilization. While other modes of sterilization can be used, it is preferred to use gamma radiation when sterilizing to provide kit 200. For this reason, all parts and components used to fabricate kit 200 should be radiation stable. It should be noted that, once sterilized, all contents of convenience kit 200 cannot be further contaminated or de-sterilized as all matter and fluid which can enter bag 40 must enter through filter component 20 which inhibits contaminated matter and sterilizes all fluid displaced there through. (Note that, unless stated differently, reference to being sterilized generally implies being sterilized to a predetermined SAL, hereafter.)

Thus, unless either the bag or filter barrier is perforated or ruptured all matter within the walls of bag 40 shall remain in an aseptic state. This permits dispensing fluids from an uncontrolled and potentially contaminating environment to be performed without regard to conditions exterior to kit 200.

For this reason, kit 200 may be considered superior to performance of the same function using a laminar flow hood. For, while the laminar flow hood provides an aseptic flowing gas-based environment, general achievement of an aseptic product requires careful technique and separate procedures to assure product sterility (as there is no facility which is part of a laminar flow hood, itself, which inherently sterilizes a product being produced therein).

Figure 8:
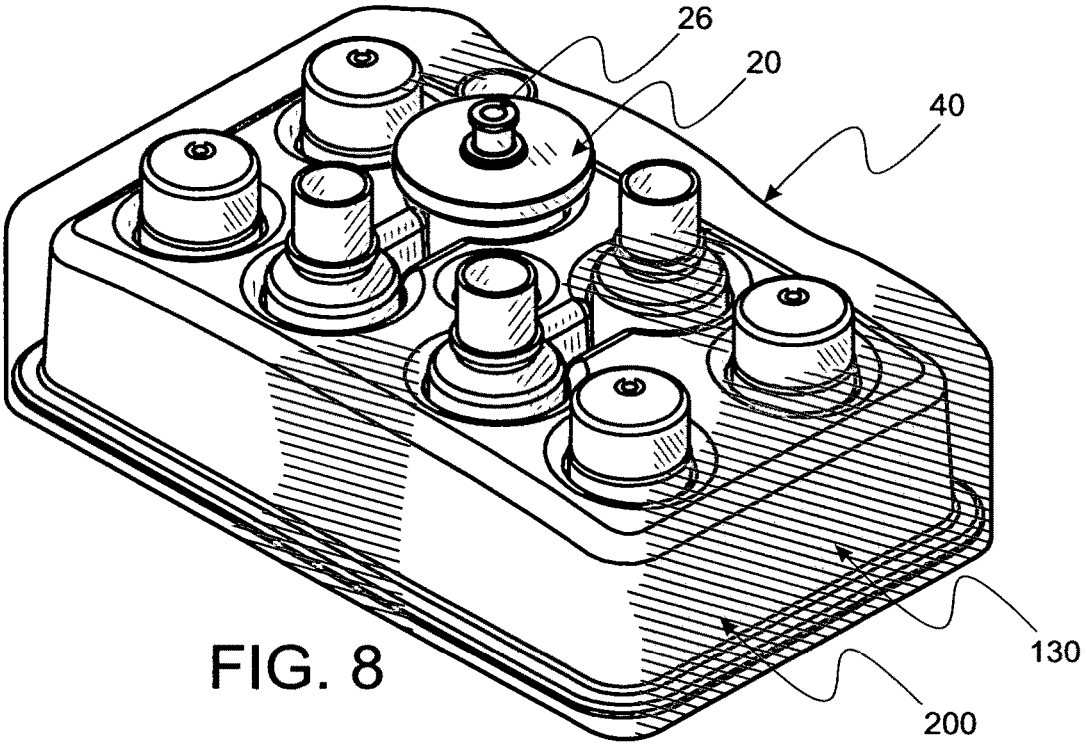
FIG. 8 is a perspective of the bag and filled receptacle seen in FIG. 7 disposed with bag folded and filter component displaced to a stable site for storage and shipping.
Figure 9:
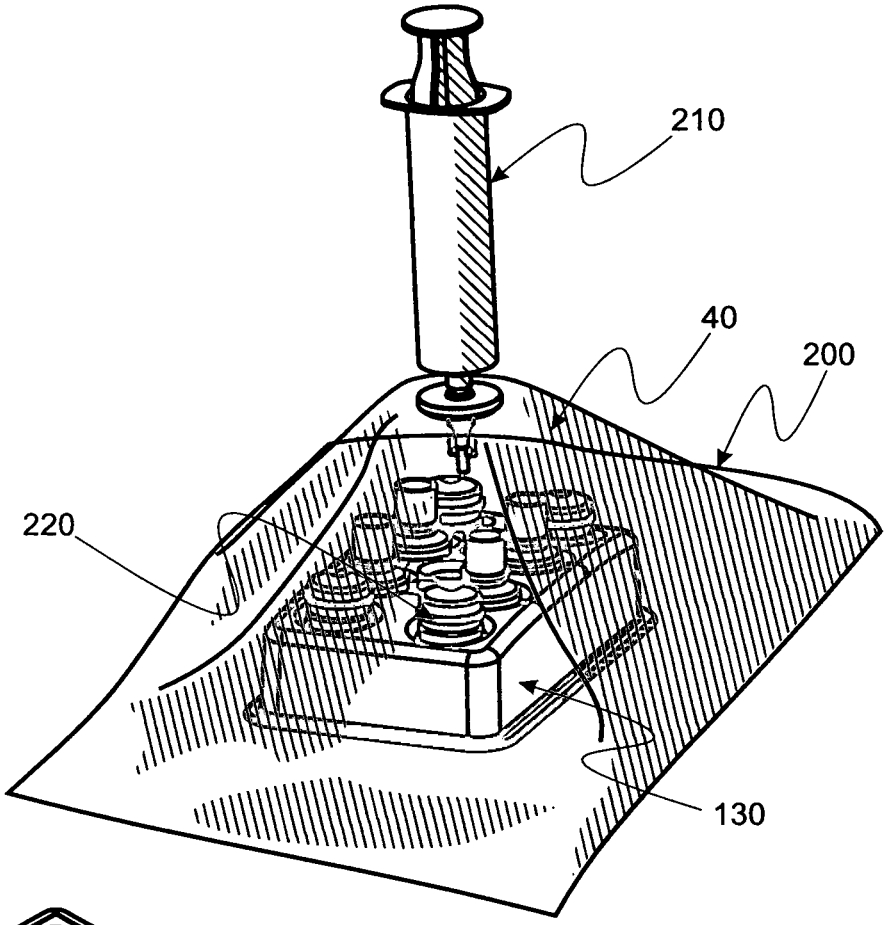
FIG. 9 is a perspective of a syringe affixed to the filter component and disposed to "tent" the bag to permit liquid product to be dispensed from the syringe into vessels within the receptacle.

As seen in FIG. 8, Female luer fitting 26 of filter component 20 of kit 200 is readily accessible for use in dispensing, through filter component, liquids into vessels within kit 200. As seen in FIG. 9, a conventional medical syringe can be affixed to fitting 26. So attached, syringe 210 may be displaced to lift or "tent" portions of bag 40 to provide a more facile access to components disposed within kit 200. Also, with or without syringe 210, filter component 20 may be so displaced to permit gas to enter bag 40 (being sterilized thereby) to establish more access space. However, once liquid has been delivered to the filter, the filter is wetted and blocks further transmission of gas there through.

As seen in FIG. 9, a so-attached syringe 210, or other luer fitting attached instrument, can be used to dispense liquid into a selected vessel 104 or cavity 108 (in the case of priming). All liquid, so dispensed, is sterilized by passage through filter component 20 such that all items and surfaces inside bag 40 remain sterile. Syringe 210 is seen to be superiorly disposed relative to a selected vessel 104 for dispensing sterilized liquid therein in FIG. 10.

Once filled each vessel must be capped to preserve sterilized product before the bag is opened to the field environment. The bag should be sized and bag material selected which permits a digital interface between cap and a users thumb and fingers to permit a cap 120 to be disengaged from a cavity 106 and displaced and be affixed to cap and seal product within a vessel 110. Sealing may involve rotating a cap, like cap 120, by threaded attachment as evidenced by vessel wall 112 (see FIG. 4). Depending upon cap material and frictional interface between bag 40 and cap 120, grasping and twisting a cap within bag 40 may be challenging. To provide an improved frictional interface, a cap 120 side attachment, such as a rubber band 220 seen in FIG. 9 can be used to provide assistance.

Figure 11:
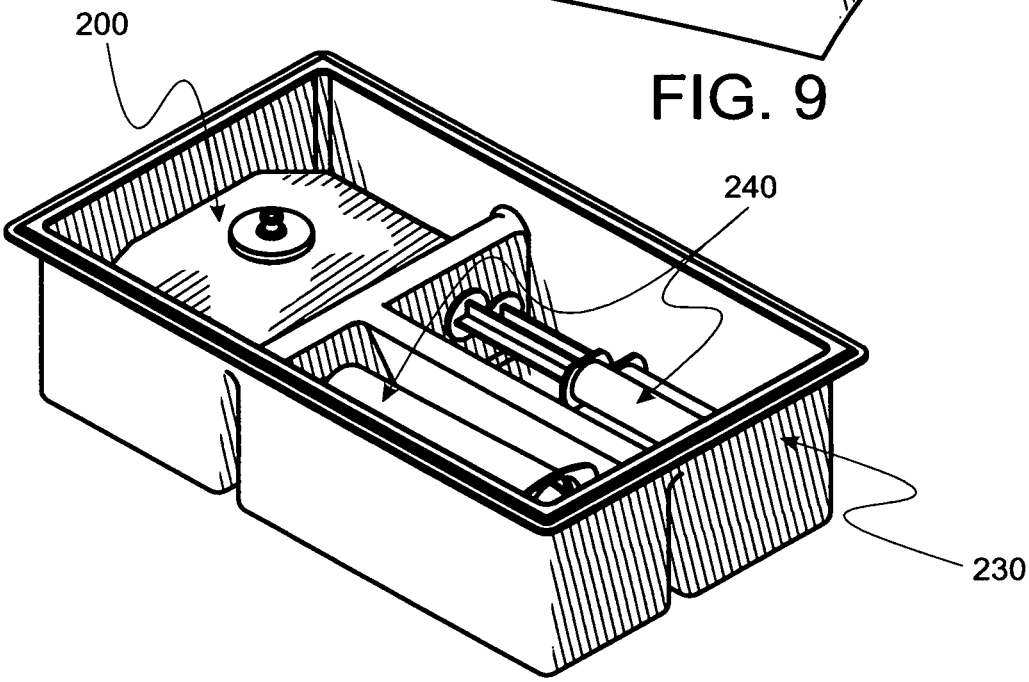
FIG. 11 is a perspective of a multi-compartment tray wherein the bagged component kit (of the instant invention) is seen to reside along with other components within a more inclusive and complex kit.
Figure 10:
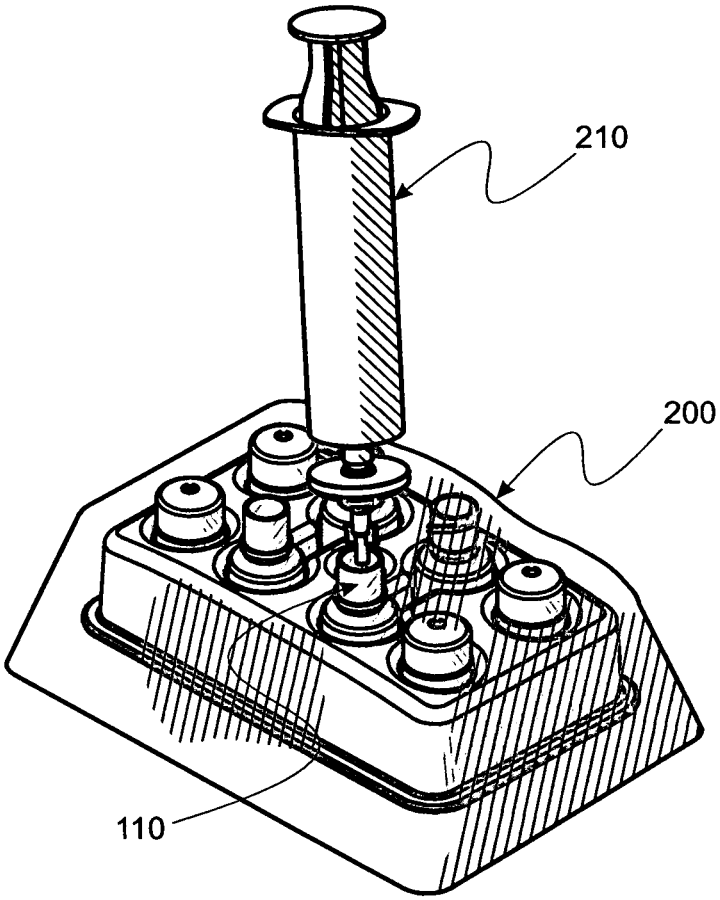
FIG. 10 is a perspective of parts seen in FIG. 9 wherein the syringe is disposed above a vessel to permit liquid dispensing therein.

Due to associated functional requirements of a procedure involving the present invention, sterilized kit 200, may become a subkit if added to a more inclusive storage and shipment kit tray 230, as seen in FIG. 11. In such a case, it is preferred that other items provided within a tray 230, generally numbered 240, be compartmentalized as seen in FIG. 11.

Figure 12:
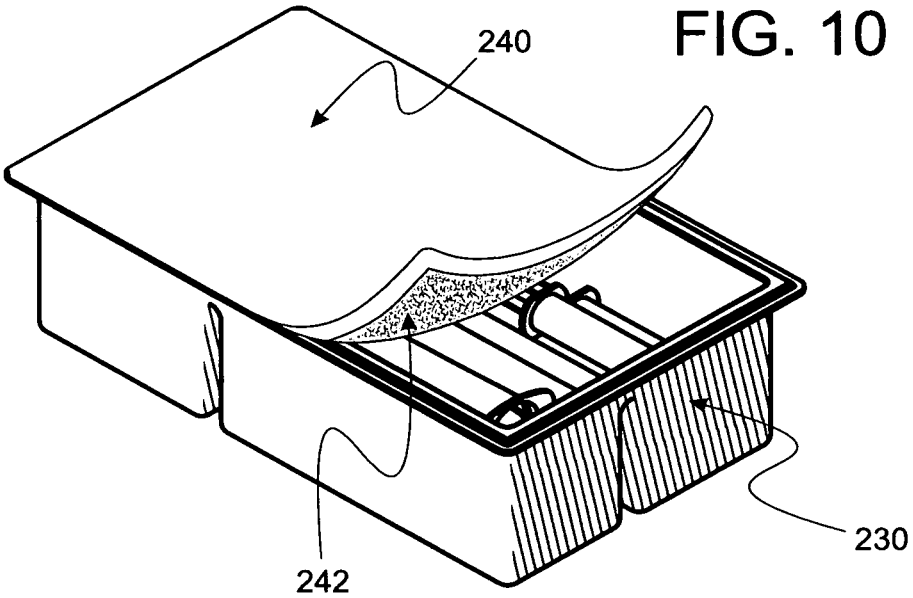
FIG. 12 is a perspective of the tray seen in FIG. 11 with a package cover partially enclosing contents of the inclusive kit.

It is preferred to provide a cover 240 which is sealingly affixed to tray 230 to protect product cleanliness as seen in FIG. 12. Note that sterility protection is not required as kit 200 is a fluid sterilizing as well as an aseptic protecting instrument. Therefore, cover 240 may be removed from tray 230 for kit component access with safety in a field environment. Also, as may be noted in FIG. 12, removing cover 240 can provide a clean work area on the underside 242 of cover 240.

Figure 13:
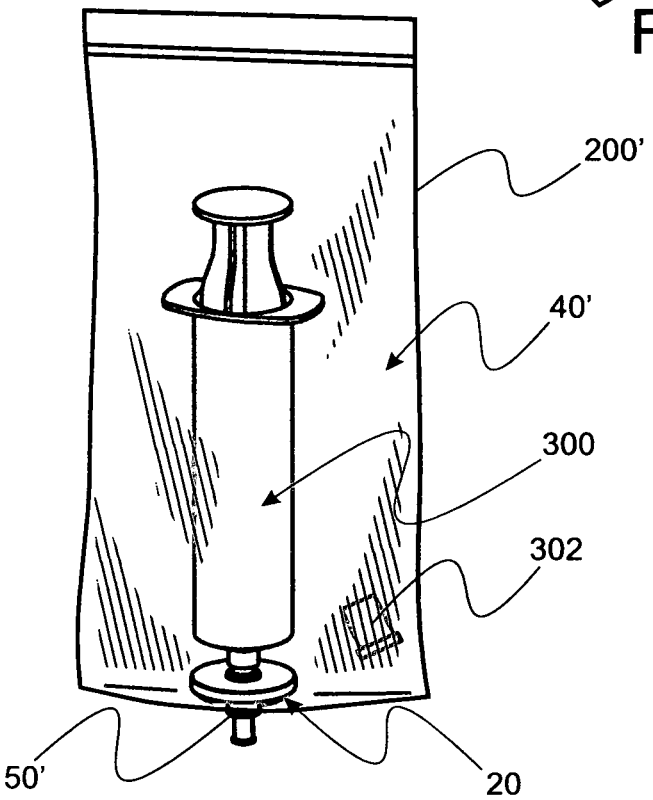
FIG. 13 is a perspective of a separate application for a convenience kit made according to the present invention wherein a syringe is disposed within a bag for receiving liquids dispensed from outside the bag.

As indicated supra, convenience kits, made according to the present invention, may be used for transferring and sterilizing liquids in many applications. To provide a broadened perception of uses of such convenience kits, a second example is seen in FIG. 13.

Therein, a syringe 300 is sealed within a bag 40' and sterilized with other components inside to provide a convenience kit 200'. A filter component 20 affixed to bag 40' at a site different from site 50 (site 50') provides a sterilizing fluid pathway into bag 40'. Thereat, component 20 is affixed to bag 40' by the same process and manner as component 20 and components 60, 80 and 70 are affixed to bag 40. In use, all liquid dispensed through filter component 20 is sterilized before reaching pre-sterilized syringe 300. Syringe 300, being so filled, is digitally detached and a conventional luer cap 302 is digitally affixed thereto to provide a sterile liquid product for use in the field environment. In this manner, such a kit can be used to transfer questionable or contaminated liquid from a container (e.g. another syringe) to be sterilized and further dispatched to syringe 300 for delivery of a sterile product to a patient in the field environment.

The invention may be embodied in many other specific forms without departing from the spirit or essential characteristics thereof. The presently disclosed embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for being disposed within an uncontrolled, unsterilized and potentially contaminating surrounding environment while being used for sterilizing and dispensing liquid into containers and for capping and sealing the containers for delivery of protectively packaged sterile product into the environment, said apparatus comprising:

a convenience kit comprising:

(a) a plurality of the containers, each container of said containers comprising an orifice through which liquid is dispensed into the container and a cap coupling;

(b) a plurality of caps, comprising one cap of the plurality of caps for each container, each cap comprising an exterior which is digitally accessible and has a connecting structure for capping, closing and sealing an associated container;

(c) a tray comprising cavities sized and shaped for holding each container and each cap in place during apparatus transport and, further, for immobilizing each container of said plurality of containers such that an associated cap of the plurality of caps can be facilely digitally affixed to the container;

(d) a filter component comprising a sterilizing grade filter disposed within a disk shaped housing and a pair of opposing extended length fluid communicating conduits, extending outward from said housing, providing a passageway to, through and from said filter;

(e) a plastic bag comprising an accessible opening for displacement of articles comprising said containers, said caps, and said tray into said bag before said opening is closed and sealed, and an exterior surface which completely envelopes and protects sterility of contents disposed therein thereby providing a completely shrouding shield for articles when said accessible opening is closed and sealed, said exterior surface further being continuous and comprising sufficient continuity and thickness to obstruct fluid displacement there through, having sufficient volume capacity to permit liquid to be displaced into each container and flexibility and suppleness for digital manipulation and having only a single hole, formed by perforating said exterior surface of said bag and closed by a gasket seal about a first conduit of said pair of opposing extended length fluid communicating conduits displaced through said hole, thereby providing for an aseptic pathway for displacing fluids into each container, said opening being closed and sealed once the contents are disposed therein and the bag and contents sterilized thereafter such that access to bag contents requires perforation of said exterior surface;

said filter component comprising a portion thereof disposed outside said bag, said portion comprising a second conduit of the pair of opposing extended length fluid communicating conduits which comprises a fitting which provides an entry orifice into the pathway, said fitting being open to the environment; and a source for delivering non-sterile liquid through said filter, said source comprising a fitting, complimentary to said filter component second conduit fitting, which is affixed to said filter component conduit fitting for communicating liquid to the containers through first conduit of the pair of opposing extended length fluid communicating conduits and for digitally maneuvering said first conduit of the pair of opposing extended length fluid communicating conduits for dispensing liquid into each container without requiring displacement of said tray.

2. The apparatus for sterilizing and dispensing liquid according to claim 1 wherein said plurality of caps each comprises an improved frictional interface for facile digital access of said cap for the purpose of digitally affixing said cap to a container through the bag.

3. The apparatus for sterilizing and dispensing liquid according to claim 1 wherein said gasket seal comprises:

(a) said first conduit of the pair of opposing extended length fluid communicating conduits disposed through said hole, said first conduit of the pair of opposing extended length fluid communicating conduits having a predetermined outside diameter;

(b) said filter component disk shaped housing comprising a planar surface, adjacent said first conduit of the pair of opposing extended length fluid communicating conduits, which is in contact with the exterior surface of said bag;

(c) a nozzle component having a fitting which joins and closes about said inserted first conduit of the pair of opposing extended length fluid communicating conduits to provide a barrier that is a predetermined distance from said planar surface; and (d) a hollow compliant tube having an internal diameter which fits fluid tight about said first conduit of the pair of opposing extended length fluid communicating conduits having a length which is longer than the predetermined distance such that, when the tube is disposed between the barrier and planar surface, a fluid tight pressurized seal is formed about said hole.

4. Apparatus for being disposed within an uncontrolled, unsterilized and potentially contaminating surrounding environment while being used for sterilizing and dispensing liquid into a single container for delivery of protectively packaged sterile product into the environment, said apparatus comprising:

a convenience kit comprising:

(a) a single container comprising a fitting through which liquid is dispensed into said container;

(b) a filter component comprising a sterilizing grade filter disposed within a disk shaped housing and a pair of opposing extended length fluid communicating conduits, extending outward from said housing, providing a passageway to, through and from said filter;

(c) a plastic bag comprising a completely shrouding shield except for an initially exposed opening through which bagged kit contents, comprising said container, and a first conduit of the pair of opposing extended length fluid communicating conduits having a fitting which is complimentary to said container fitting and thereby affixed thereto, are displaced into the bag to be completely enclosed therein, said bag comprising a continuous surface which comprises sufficient continuity and thickness to obstruct fluid displacement there through, sufficient volume capacity to permit liquid to be displaced into said container and only a single hole, formed by perforating said surface of said bag and closed by a gasket seal about said first conduit of the pair of opposing extended length fluid communicating conduits displaced through said hole, thereby providing for an aseptic pathway for displacing fluids into said container, said opening being closed and sealed once the contents are disposed therein and said bag and the contents sterilized thereafter such that access to bag contents requires perforation of said surface;

said filter component comprising a portion thereof disposed outside said bag, said portion comprising a second conduit of the pair of opposing extended length fluid communicating conduits which comprises a fitting which provides an entry orifice into the pathway, said fitting being open to the environment; and a source for delivering non-sterile liquid through said filter, said source comprising a discharge fitting, complimentary to the filter component conduit fitting, which is affixed to the filter conduit fitting for communicating liquid to the container through first conduit of the pair of opposing extended length fluid communicating conduits.

* * * * *